US011180938B2

(12) United States Patent
Sakuma

(10) Patent No.: US 11,180,938 B2
(45) Date of Patent: Nov. 23, 2021

(54) HINGE

(71) Applicant: SUGATSUNE KOGYO CO., LTD., Tokyo (JP)

(72) Inventor: Kentaro Sakuma, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/490,518

(22) PCT Filed: Feb. 7, 2018

(86) PCT No.: PCT/JP2018/004233
§ 371 (c)(1),
(2) Date: Aug. 30, 2019

(87) PCT Pub. No.: WO2018/159243
PCT Pub. Date: Sep. 7, 2018

(65) Prior Publication Data

US 2020/0011103 A1 Jan. 9, 2020

(30) Foreign Application Priority Data

Mar. 3, 2017 (JP) ..... JP2017-040558

(51) Int. Cl.
*E05D 5/04* (2006.01)
*E05D 3/02* (2006.01)
(Continued)

(52) U.S. Cl.
CPC ..... *E05D 5/046* (2013.01); *E05D 3/02* (2013.01); *E05D 7/081* (2013.01); *E05D 7/0045* (2013.01);
(Continued)

(58) Field of Classification Search
CPC ..... E05D 5/046; E05D 3/02; E05D 7/081; Y10T 16/534
See application file for complete search history.

(56) References Cited

U.S. PATENT DOCUMENTS 6,766,561 B1 * 7/2004 Cheng ..... E05D 5/0246 16/235
6,874,200 B2 4/2005 Van Parys
(Continued)

FOREIGN PATENT DOCUMENTS

DE 3511027 A1 10/1986
FR 2971807 A1 8/2012
(Continued)

OTHER PUBLICATIONS

Chinese Office Action dated Jul. 2, 2020 in Chinese Application No. 201880012826.6, Total 16 pages with translation.
(Continued)

*Primary Examiner* — Victor D Batson
*Assistant Examiner* — Matthew J Sullivan
(74) *Attorney, Agent, or Firm* — Masuvalley & Partners

(57) ABSTRACT

An object is to provide a hinge which can attach a supporting part for supporting rotatably a holder part easily to the holder part holding the door.
A hinge comprises a holder part for holding a door (front-side body receiving a left-and-right adjustment segment and back-side body), a supporting part for supporting rotatably the holder part (resin bush inserted in a rotation shaft), and a connection part (resin catcher) for connecting the holder part to the supporting part, and the resin catcher comprises an attachment part (recesses) for attaching to the holder part and a pawl for gripping elastically the supporting part.

10 Claims, 13 Drawing Sheets

(51) Int. Cl.
*E05D 7/081* (2006.01)
*E05D 7/00* (2006.01)
*E05D 9/00* (2006.01)

(52) U.S. Cl.
CPC ..... *E05D 9/00* (2013.01); *E05Y 2600/12* (2013.01); *E05Y 2600/20* (2013.01); *E05Y 2600/312* (2013.01); *E05Y 2800/45* (2013.01); *E05Y 2800/674* (2013.01); *E05Y 2900/20* (2013.01)

(56) References Cited

U.S. PATENT DOCUMENTS

| | | | | |
|---|---|---|---|---|
| 8,578,556 | B1 | 11/2013 | Yu | |
| 8,839,490 | B2 * | 9/2014 | Vogler | E05D 1/02 16/252 |
| 9,879,456 | B1 * | 1/2018 | Chen | E05D 3/02 |
| 10,113,346 | B2 * | 10/2018 | Kohlweiss | E05D 5/128 |
| 10,480,230 | B2 * | 11/2019 | Brun | E05D 7/0415 |
| 10,603,598 | B2 * | 3/2020 | Kwan | E05D 3/02 |
| 2006/0207060 | A1 * | 9/2006 | Cheng | E05D 5/0246 16/252 |
| 2013/0283567 | A1 * | 10/2013 | Yamaguchi | E05D 7/1044 16/260 |
| 2017/0044809 | A1 * | 2/2017 | Chiste | F16G 3/02 |
| 2020/0131819 | A1 * | 4/2020 | Iwata | E05D 7/04 |
| 2020/0165849 | A1 * | 5/2020 | Olkay | E05D 7/0415 |

FOREIGN PATENT DOCUMENTS

| | | | |
|---|---|---|---|
| JP | S60-115364 | U | 8/1985 |
| JP | 06-054875 | U | 7/1994 |
| JP | 06-050629 | Y | 12/1994 |
| JP | 06-083883 | U | 12/1994 |

OTHER PUBLICATIONS

WIPO, Japanese International Search Authority, International Search Report with English Translation and Written Opinion dated Mar. 13, 2018 in International Patent Application No. PCT/JP2018/004233, 8 pages.

EPO, Supplementary European Search Report dated Nov. 30, 2020 in European Application No. EP18760877, 2 pages.

* cited by examiner

HINGE

RELATED APPLICATIONS

This application is the U.S. National Phase of and claims priority to International Patent Application No. PCT/JP2018/004233, International Filing Date Feb. 7, 2018, entitled Hinge; which claims benefit of Japanese Application No. 2017-040558 filed Mar. 3, 2017; both of which are incorporated herein by reference in their entireties.

TECHNICAL FIELD

The present invention relates to a hinge for supporting rotatably a door.

BACKGROUND ART

Conventionally, a hinge, which includes a holder part (patch plate and hinge body) and a supporting part (supporting shaft and plain bearing) for supporting rotatably the holding part (patch plate and hinge body), has been known (for example, refer to Patent Literature 1).

CITATION LIST

Patent Literature

Patent Literature 1: Japanese Utility Model (Examined) No. Heisei 6-50629

SUMMARY OF INVENTION

Problem to be Solved by Invention

In a configuration disclosed in Patent Literature 1, for attaching a supporting part (supporting shaft and plain bearing) to a receptacle member, working including inserting the supporting part (supporting shaft and plain bearing) into the receptacle member and then enclosing the supporting part (supporting shaft and plain bearing) into the receptacle member by a cap body is required. At that time, since the supporting part (supporting shaft and plain bearing) tends to escape from the receptacle member, the working for screwing and the like is not easy.

An abject of the present invention is to provide a hinge for making it easy to attach the supporting part for supporting rotatably a holder part to a holder part for holding a door.

Solution to Problem

A hinge of the present invention for achieving the above object comprises a holder part for holding a door, a supporting part for supporting rotatably the holder part, and a connection part for connecting the holder part to the supporting part; the connection part comprises an attachment part for attaching to the holder part and a pawl for elastically gripping the supporting part.

Advantageous Effects of Invention

According to such hinge, the supporting part for supporting rotatably a holder part can be attached easily to a holder part for holding a door.

DESCRIPTION OF EMBODIMENTS

Hereinbelow, with reference to attached drawings, a first embodiment and a second embodiment will be explained. In drawings, the same sign is provided with the same member and redundant explanation will be omitted.

In each figure, the arrows represented by X, Y and Z are used to indicate orientation of a hinge. A direction of the arrow represented by X indicates a thickness (depth) direction X of the hinge. A direction of the arrow represented by Y indicates a lateral width direction Y of the hinge. A direction of the arrow represented by Z indicates a height direction Z of the hinge.

FIRST EMBODIMENT

Figure 3:
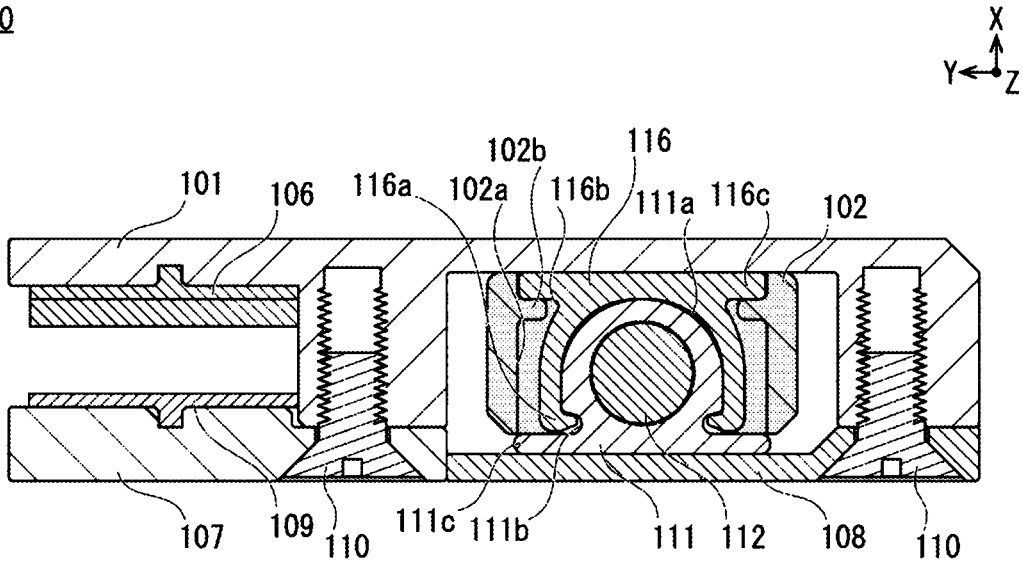
FIG. 3 shows a top view of the hinge with a cross section along a horizontal plane (lateral width direction Y and thickness direction X).

With reference to FIG. 3, generally a hinge 100 of the present invention according to the first embodiment, comprises a holder part (front-side body 101 receiving a left-and-right adjustment segment 102 and a back-side body 107) for holding a door 502, a supporting part for supporting rotatably the holder part (resin bush 111 inserted in a rotation shaft 112), and a connection part (resin catcher 116) for connecting the holder part to the supporting part and the resin catcher 116 comprises attachment part (recesses 116*b*) for attaching to the holder part and pawls 116*a* for gripping elastically the supporting part.

Particularly, the hinge 100 includes a pair of the holder parts for holding with sandwiching the door 502 (front-side body 101 receiving the left-and-right adjusting segment 102 and the back-side body 107), a supporting part (resin bush 111 inserted in the rotation shaft 112) for supporting rotatably either one of a pair of the holder parts, an attachment part (recess 116*b*) being inserted into a hole 102*a* formed in the holder part at a supported side with the supporting part (front-side body 101 receiving the left-and-right adjustment segment 102) for attaching to and engaging with the inside of the hole 102*a*, and also the connection part (resin catcher 116) for connecting the holding part at the supported side by the holder part to the supporting part; to the resin catcher, the elastically deformable pawls 116*a* for connecting to the supporting part are formed and the recesses 116*b* are formed at a base-end side and top-end sides of the pawls 116*a* are inserted in the hole 102*a* with a elastically deformed state.

Configuration of Hinge 100

With reference to FIG. 1-FIG. 4, a configuration of the hinge 100 will be explained.

Figure 1:
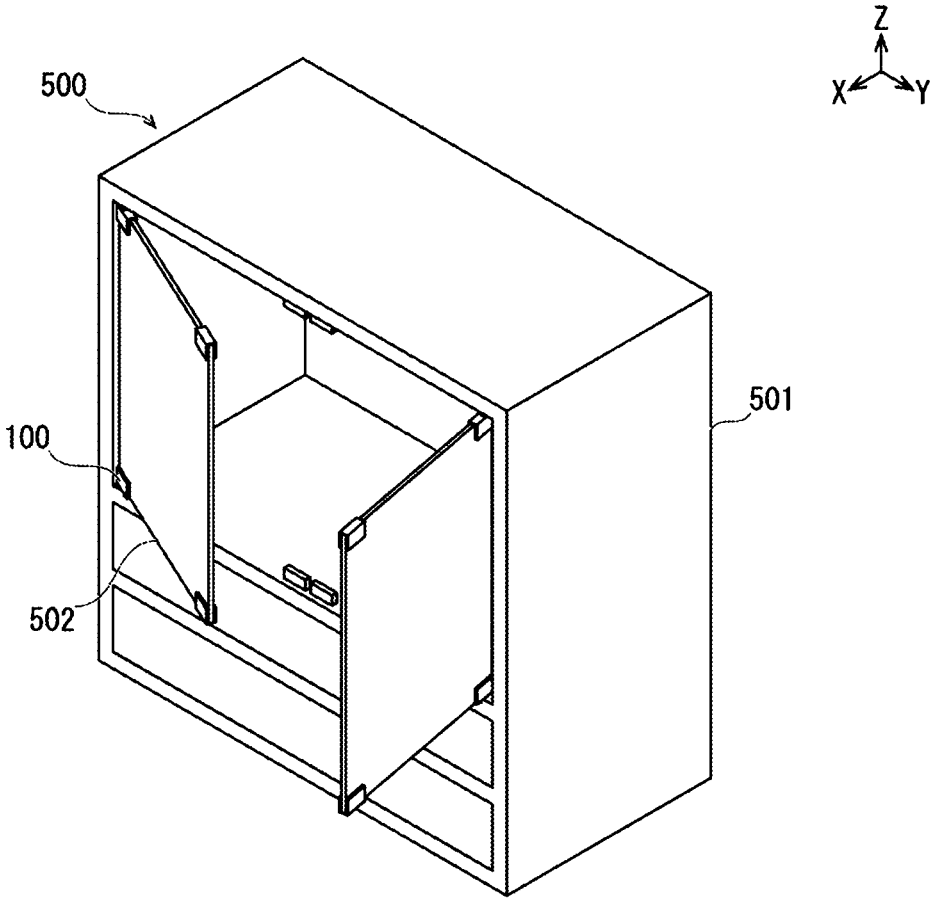
FIG. 1 shows a perspective view of a storage shelf 500 using a hinge of the first embodiment.
Figure 2A:
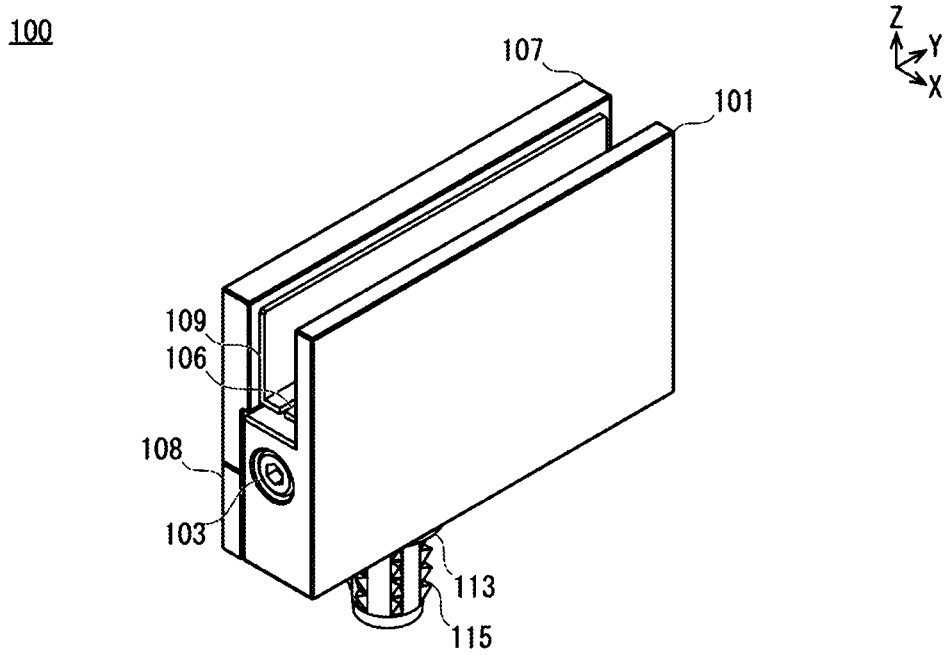
FIG. 2A shows a perspective view of the hinge illustrated from the front side.
Figure 2B:
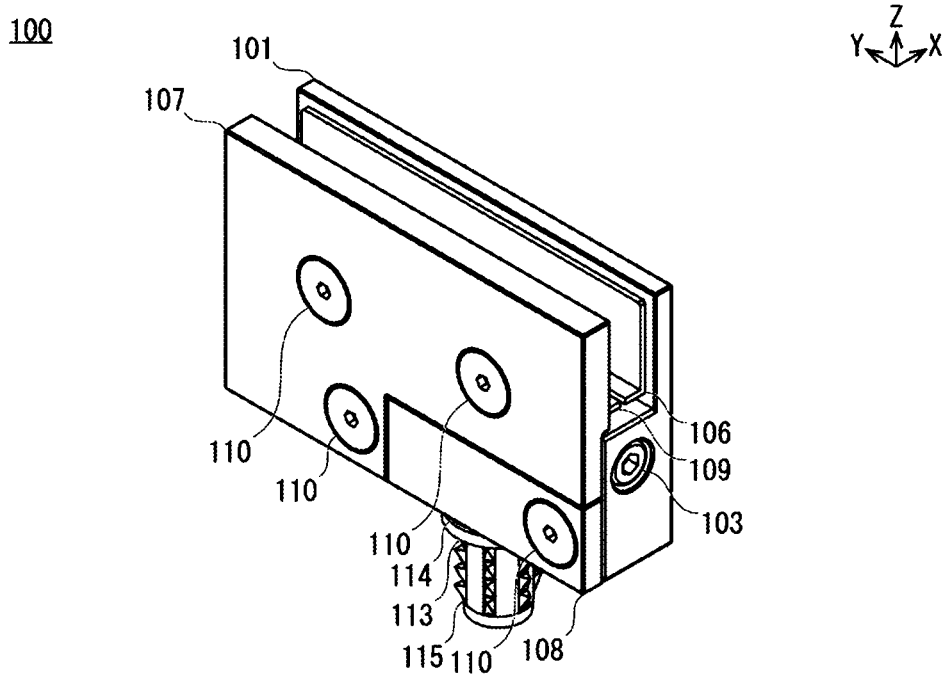
FIG. 2B shows a perspective view of the hinge illustrated from the back side.
Figure 4:
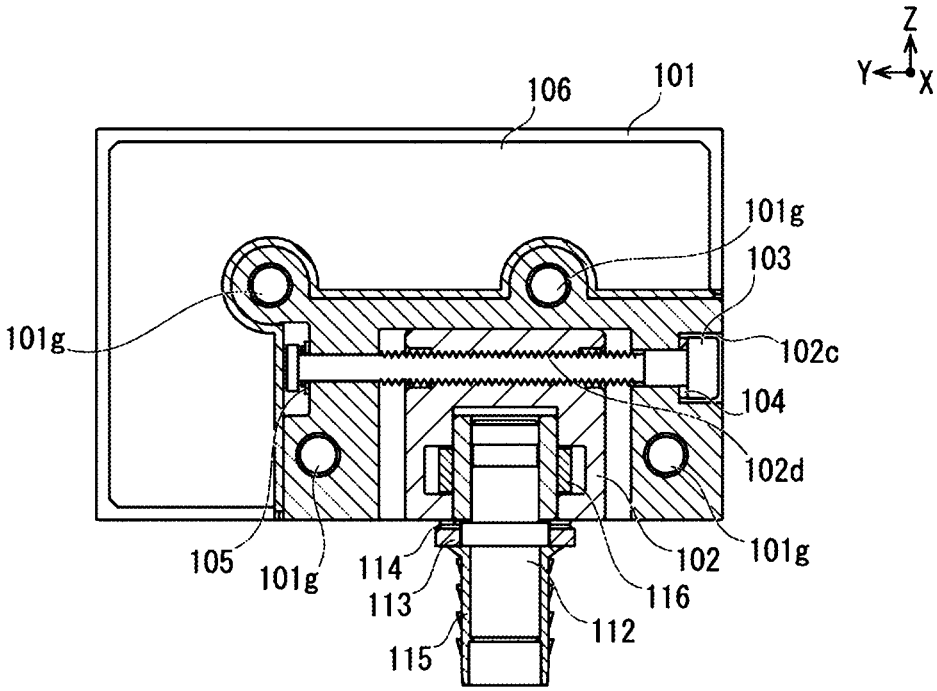
FIG. 4 shows a side view with a cross section along a vertical plane (lateral width direction Y and height direction Z).
Figure 5:
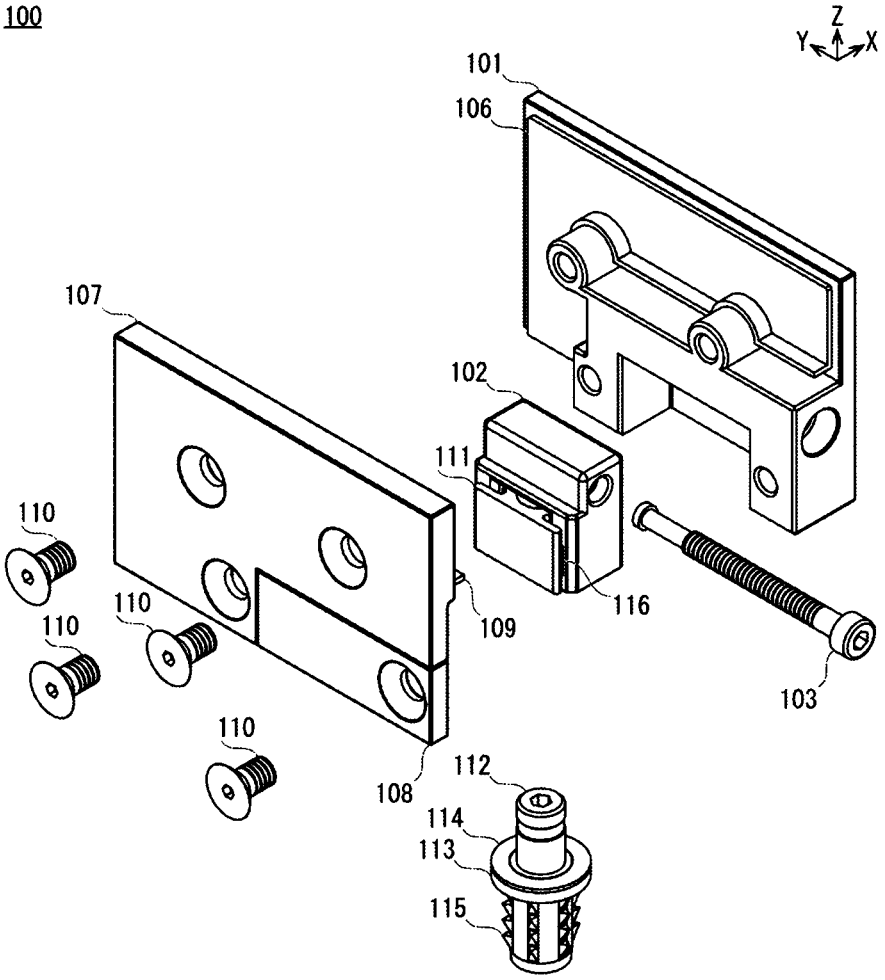
FIG. 5 shows a perspective view of the hinge with exploding partially and viewed from the back side.
Figure 6A:
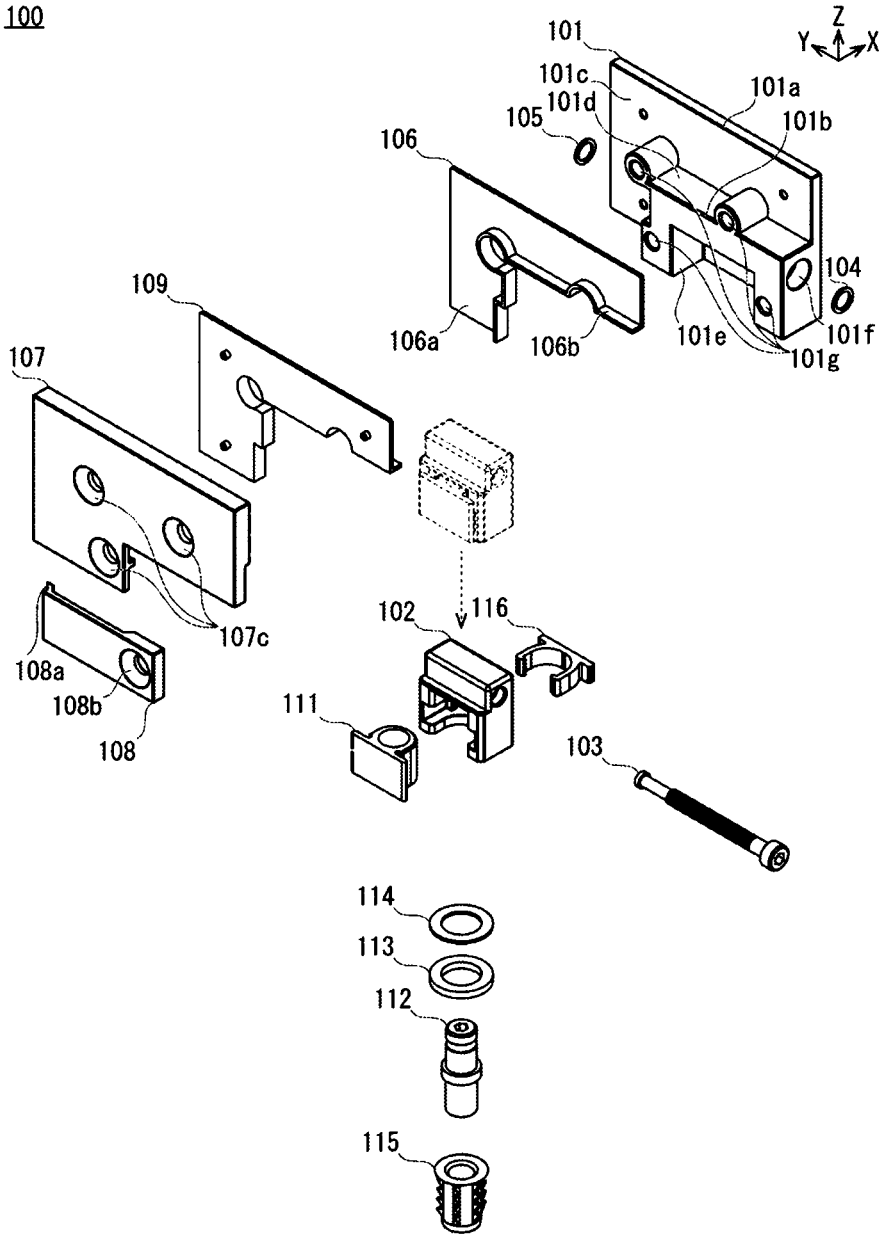
FIG. 6A shows a perspective view of the hinge with exploding entirely and viewed from the back side.
Figure 6B:
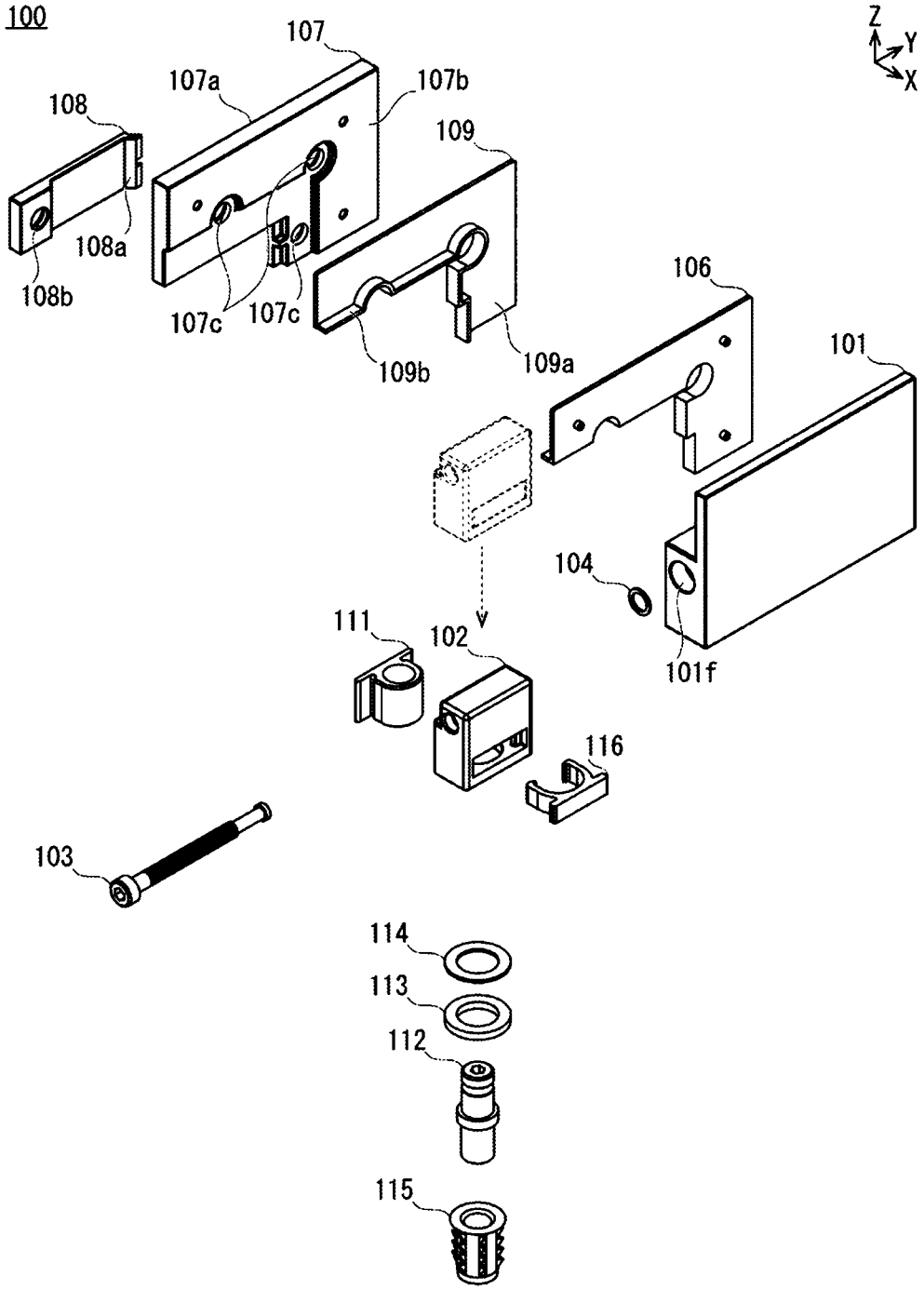
FIG. 6B shows a perspective view of the hinge with exploding entirely and viewed from the front side.
Figure 7A:
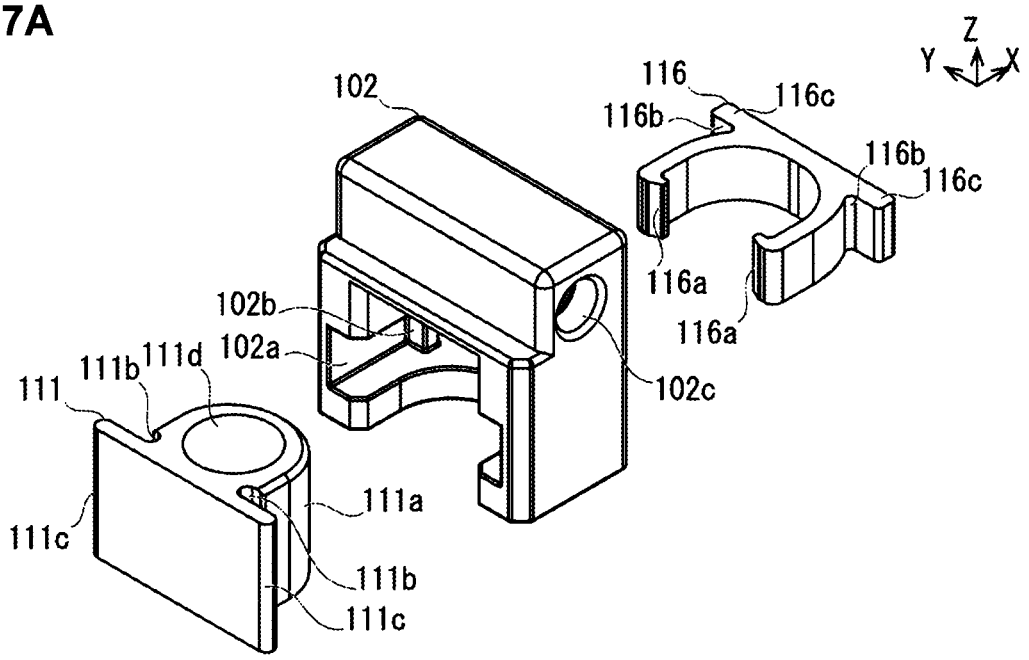
FIG. 7A is a perspective view of the resin bush, the left-and-right adjustment segment and the resin catcher of the hinge viewed from the back side.
Figure 7B:
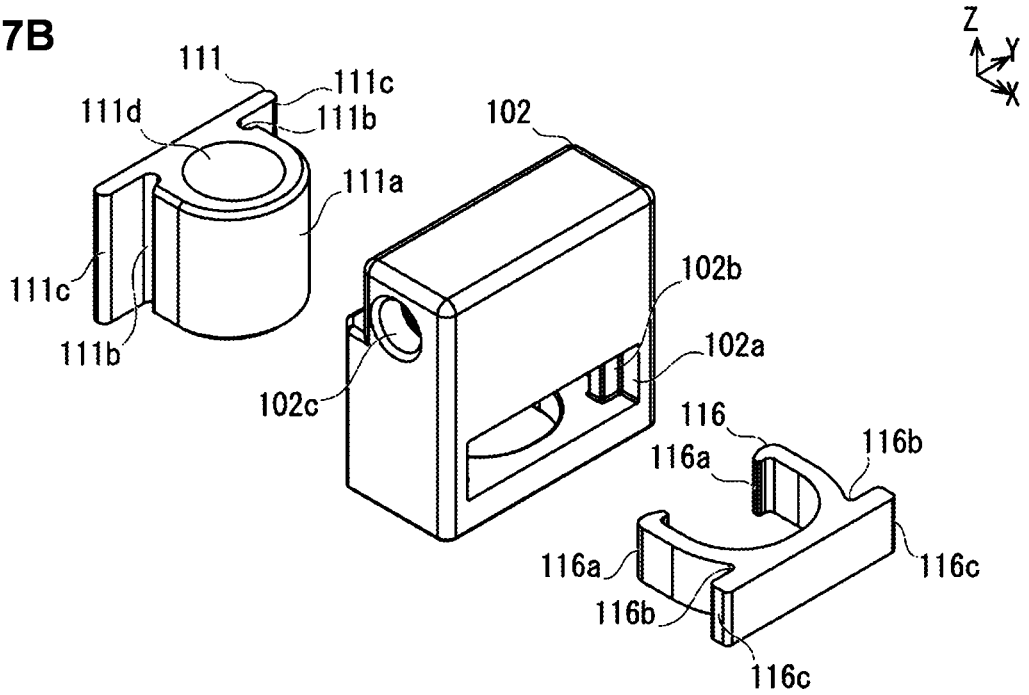
FIG. 7B shows a perspective view of the resin bush, the left-and-right adjustment segment and the resin catcher of the hinge from the front side.

FIG. 1 shows a perspective view of a storage shelf 500 using a hinge of the first embodiment. FIG. 2A shows a perspective view of the hinge 100 illustrated from the front side. FIG. 2B shows a perspective view of the hinge 100 illustrated from the back side. FIG. 3 shows a top view of the hinge 100 with a cross section along a horizontal plane (lateral width direction Y and thickness direction X). FIG. 4 shows a side view with a cross section along a vertical plane (lateral width direction Y and height direction Z). FIG. 5 shows a perspective view of the hinge 100 with exploding partially and viewed from the back side. FIG. 6A shows a perspective view of the hinge 100 with exploding entirely and viewed from the back side. FIG. 6B shows a perspective view of the hinge 100 with exploding entirely and viewed from the front side. In FIGS. 6A and 6B, illustrations of hexagon socket countersunk head screws 110 are omitted. FIG. 7A shows a perspective view of the resin bush 111, the left-and-right adjustment segment 102 and the resin catcher 116 of the hinge 100 viewed from the back side. FIG. 7B shows a perspective view of the resin bush 111, the left-and-right adjustment segment 102 and the resin catcher 116 of the hinge 100 from the front side.

The hinge 100 is one, for example, that holds rotatably the door 502 to a casing 501 of the storage shelf 500. The hinge 100 is, in a frontward opened state, explained as an L-hinge (left hanging member) which has a joint at a left side, however, the explanation may be applied to an R-hinge (right hanging member) which has a joint at a right side as well. The hinge 100 will be explained as one that holds rotatably the door 502 from below, however, the explanation may be applied to one that holds rotatably the door 502 from above as well. The front-side body 101-the resin catcher 116 configuring the hinge 100 will be explained in turn.

The front-side body 101 is shown in FIG. 2A-FIG. 6A and is one that holds the door 502 from one side (front side). The front-side body 101 includes a base part 101*a* opposing to the door 502, a protrusion part 101*b* protruding from the base part 101*a* toward a lower direction of the door 502. The front-side body 101 holds the door 502 through a front-side packing 106 by a lateral side 101*c* of the base part 101*a* and a placement face 101*d* corresponding to an upper face of the protrusion part 101*b*. The protrusion part 101*b* is formed with a receptacle part 101*e* for receiving the left-and-right adjustment segment 102, an insertion hole 101*f* for inserting the left-and-right adjustment screw 103 and three screw holes 101*g* for screwing the hexagon socket countersunk head screws 110. The front-side body 101, for example, consists of yellow copper.

The left-and-right adjustment segment 102 is shown in FIG. 3-FIG. 7B and is one that adjusts a position of the door 502 held by the front-side body 101. The left-and-right adjustment segment 102 is received movably along the lateral width direction Y in the receptacle part 101*e* of the front-side body 101. The left-and-right adjustment segment 102 is formed with a hole 102*a* for receiving the resin catcher 116, a convex part 102*b* protruding inwardly toward the inside of the hole 102*a*, a through hole 102*c* for inserting the left-and-right adjustment screw 103 and a screw hole 102*d* to which a thorough hole 102*c* corresponding to the left-and-right adjustment screw 103 is formed at the top end. The left-and-right adjustment segment 102, for example, consists of yellow copper.

The left-and-right adjustment screw 103 is shown in FIG. 2A, FIG. 2B and FIG. 4-FIG. 6B, and is one that makes the left-and-right adjustment segment 102 move along the lateral width direction Y. The left-and-right adjustment screw 103 is connected to the screw hole 102*d* under the state being inserted through the through hole 102*c* of the left-and-right adjustment segment 102. When rotating the left-and-right adjustment screw 103, the left-and-right adjustment segment 102 moves along the lateral width direction Y under the condition contacting to the front-side body 101.

A spring washer 104 is one, as shown in FIG. 4, FIG. 6A and FIG. 6B, disposed between the left-and-right adjustment screw 103 and the left-and-right adjustment segment 102, that provides urging force so as to prevent rattling.

A plain washer 105 is one, as shown in FIG. 4 and FIG. 6A, disposed between the left-and-right adjustment screw 103 and the left-and-right adjustment segment 102, that makes rotation of the left-and-right adjustment screw 103 smooth.

The front-side packing 106 is one, as shown in FIG. 2A-FIG. 6B, disposed between the left-and-right adjustment screw 103 and the left-and-right adjustment segment 102, that protects the door 502 from the side of the front-side body 101. The front-side packing 106 is disposed between the front-side body 101 and the door 502. The front-side packing 106 consists of a shape conformed along a part of the lateral face 101*c* of the front-side body 101 and the placement face 101*d*, and is sufficiently thinner than the front-side body 101. The front-side packing 106 makes, while making the surface of the door 502 contact closely on the lateral face 106*a*, the door 502 place on the placement face 101*d*. The front-side packing 106, for example, consists of chloroprene rubber.

The back-side body 107 is one that holds the door 502 at one side (from the back side) opposing to the front-side body 101. The back-side body 107 includes a base part 107*a* opposing to the door 502. The back-side body 107 holds the door 502 through a back-side packing 109 by the lateral side 107*b* of the base part 107*a*. The base part 107*a* is formed with through holes 107*c* for being inserted with the hexagon socket countersunk head screws 110. The back-side body 107, likely to the front-side body 101, consists of yellow copper.

A back cover 108 is shown in FIG. 2B, FIG. 3, and FIG. 5-FIG. 6B and is one that protects the resin bush 111 and the like received in the left-and-right adjustment segment 102 by covering thereof. The back cover 108 includes a pawl 108*a* for engaging with and fixing to the back-side body 107 and a through hole 108*b* for inserting the hexagon socket countersunk head screw 110. The back cover 108, for example, consists of yellow copper.

A back-side packing 109 is shown in FIG. 2A-FIG. 3 and FIG. 5-FIG. 6, and is one that protects the door 502 from the side of the back-side body 107. The back-side packing 109 is disposed between the back-side body 107 and the door 502. The back-side packing 109 consists of a shape conformed along the lateral side 107*b* of the back-side body 107 and a part of the placement face 101*d* of the front-side body 101, and is sufficiently thinner than the back-side body 107. The back-side packing 109 makes, while making the back face of the door 502 contact closely to the lateral face 109*a*, the door 502 place on the placement face 109*b*. The back-side packing 109, for example, as the front face packing 106, consists of chloroprene rubber.

The hexagon socket countersunk head screw 110 is shown in FIG. 2B, FIG. 3 and FIG. 5 and is one that screws the front body 101 and the back-side body 107 as well as the front-side body 101 and the back cover 108. Three hexagon socket countersunk head screws 110 are inserted into three through holes 107*c* disposed to the back-side body 107 and are screwed to three screw holes among four screw holes disposed to the front-side body 101. Similarly, one hexagon socket countersunk head screw 110 is inserted into one through hole 108*b* disposed to the back cover 108 and is also screwed to one screw hole 101*g* among four screw holes disposed to the front-side body 101.

The resin bush 111 is shown in FIG. 3-FIG. 7B and is one that supports rotatably the front-side body 101 receiving the left-and-right adjustment segment 102. The resin bush 111 is attached rotatably to a rotation axis 112 and is also connected to the resin catcher 116. The resin bush 111 is contacted by a pair of pawls 116*a* of the resin catcher 116 onto an outer circumference face 111*a* having a cylinder shape. In the resin bush 111, a pair of concave ends 111*b* formed by cutting a part along an axial direction, is connected to a pair of pawls 116*a* of the resin catcher 116. The resin bush 111 is formed with a pair of flanges 111*c* each having a rectangular shape extended outwardly from a pair of the ends 111*b*. The resin bush 111 is formed with a hole 111*d* at the center into which the rotation axis 112 is inserted. The resin bush 111, for example, consists of polyacetal.

The rotation axis 112 is shown in FIG. 3-FIG. 6B and is one that supports the resin bush 111. The rotation axis 112 is inserted, under the condition that the resin bush 111 is inserted and supported, into a rasp-cut nut 115. The rotation axis 112, for example, consists of stainless steel.

The plain washer 113 is shown in FIG. 2A, FIG. 2B and FIG. 4-FIG. 6B and is one that provides a certain gap between the door 502 and the casing 501 and makes rotation smooth by receiving loads of the door 502 and the like. The plain washer 113 is inserted to the rotation axis 112 from above.

A resin washer 114 is shown in FIG. 2B-FIG. 4-FIG. 6B and is one that has the function similar to the plain washer 113. The resin washer 114 is inserted to the rotation axis 112 as stacked to the plain washer 113 from above.

The rasp-cut nut 115 is shown in FIG. 2A, FIG. 2B and FIG. 4-FIG. 6 and is one that the rotation axis 112 is inserted to support thereof. The rasp-cut nut 115 is embedded in a hole formed to the casing 501 shown in FIG. 1.

The resin catcher 116 is shown in FIG. 3-FIG. 7B and is one that connects the front-side body 101 receiving the left-and-right adjustment segment 102 to the resin bush 111 inserted into the rotation axis 112. The resin catcher 116 includes the recesses 116b inserted to the hole 102*a* of the left-and-right adjustment segment 102 so as to engage with and attach to the convex part 102*b* formed in the hole 102*a*. The resin catcher 116 is formed with the elastically deformable pawls 116*a* being connectable to the resin bush 111. The pawls 116a consist of a pair. The resin catcher 116 passes through, under the condition that tops of the pawls 116*a* are deformed toward inside, the convex part 102*b* formed inside the hole 102*a* of the left-and-right adjustment segment 102, and is then inserted into the hole 102*a* of the left-and right adjustment segment 102. The resin catcher 116 is held by sandwiching the flanges 116*c* formed at the base end sides of the pawls 116*a* between the back cover 108 adjacent to the front-side body 101 and the left-and-right adjustment segment 102. The resin catcher 116 is held by surface-contact of the entire face of the back side including the flange 116*c* to the front-side body 101. The resin catcher 116, for example, consists of polyacetal.

Main Part of Assembling Hinge 100

With reference to FIG. 8A-FIG. 8F, a main part of a method for assembling the hinge 100 will be explained.

FIG. 8A-FIG. 8F show perspective views of a main part of the method for assembling the hinge 100. With respect to FIG. 8A-FIG. 8C, for easy understanding of the invention, the resin bush 111, the left-and-right adjustment segment 102, and the resin catcher 116 are shown as cross sections along the horizontal plane (lateral width direction Y and thickness direction X).

Figure 8A:
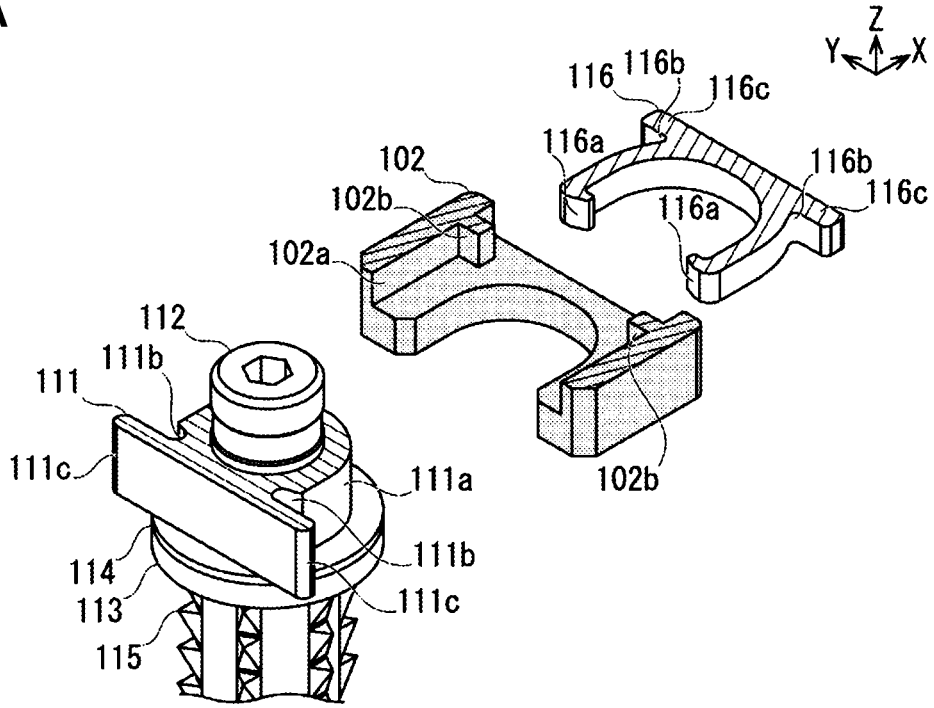
FIG. 8A shows a perspective view of a main part of a method for assembling the hinge in a state that the resin bush, the left-and-right adjustment segment, and the resin catcher are shown as cross sections along the horizontal plane (lateral width direction Y and thickness direction X) is shown with respect to the resin bush inserted into a rotation axis 112, the left-and-right adjustment segment, and the resin catcher in a state prior to assembly thereof.

As shown in FIG. 8A, the resin catcher 116 is positioned at the front side of the left-and-right adjustment segment 102. A pair of the pawls 116*a* of the resin catcher 116 is faced oppositely to the hole 102*a* of the left-and-right adjustment segment 102. The rasp-cut nut 115, into which the rotation axis 112 is inserted to support thereof, is embedded in the casing 501 (not shown in FIG. 8A-FIG. 8F) for attaching the door 502 shown in FIG. 1. The resin bush 111 is inserted rotatably into the rotation axis 112 into which the plain washer 113 and the resin washer 114 are inserted.

Figure 8B:
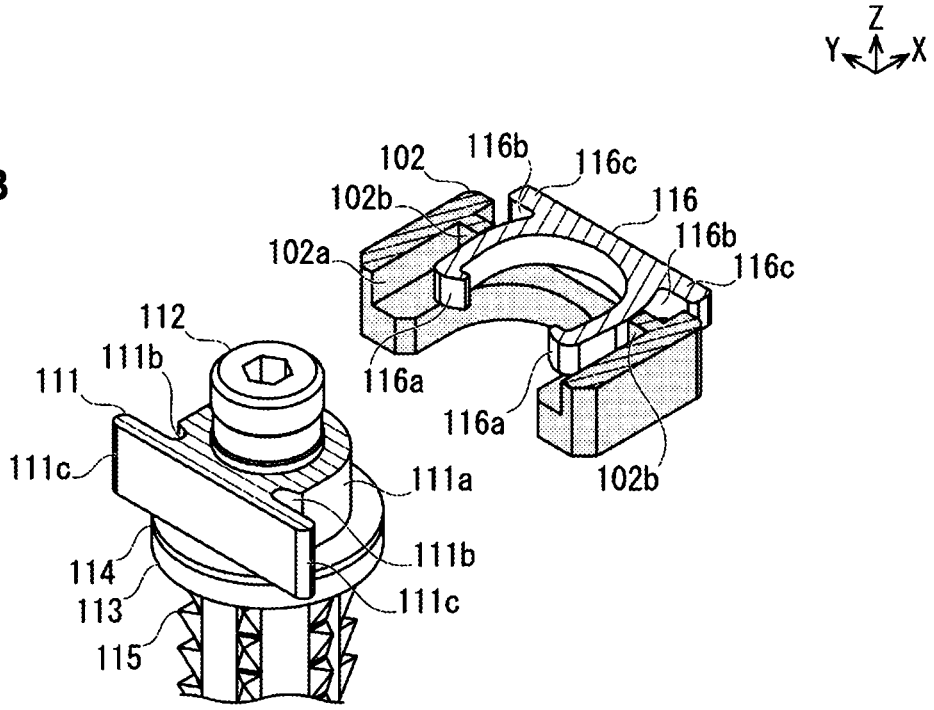
FIG. 8B shows, subsequently to the state of FIG. 8A, under the condition that a pair of pawls of the resin catcher is deformed inwardly, a state on a way for inputting into a hole of the left-and-right adjustment segment making pass through a concave part.

As shown in FIG. 8B, subsequently to the state of FIG. 8A, the resin catcher 116 is made to approach toward the left-and right adjustment segment 102 from the front side. Here, a pair of the pawls 116*a* of the resin catcher 116 is, for example, by nipping them with a thumb and an index finger, deformed as bending toward the inside. That is, tops of a pair of the pawls 116*a* are narrowed beforehand along the lateral width direction Y. The tops of a pair of the pawls 116*a* of the resin catcher 116 become contact slightly to the convex part 102*b* formed to the hole 102*a* of the left-and-right adjustment segment 102. In that state, a pair of the pawls 116*a* of the resin catcher 116 is being inserted into the hole 102*a* of the left-and right adjustment segment 102.

Now, in the state shown in FIG. 8B, without narrowing a pair of the pawls 116*a* of the resin catcher 116 by nipping with the thumb and the index finger, the resin catcher 116 may be simply approached to the left-and-right adjustment segment 102 from the front side. In this instance, the tops of a pair of the pawls 116*a* of the resin catcher 116 contact to the convex part 102*b* formed to the hole 102*a* of the left-and right adjustment segment 102. When approached more and more, a pair of the pawls 116*a* of the resin catcher 116 becomes deformed to bend with receiving repulsion force from the convex part 102*b* of the left-and-right adjustment segment 102. As the result, the tops of a pair of the pawls 116*a* decrease their mutual distance along the lateral width direction Y. In this state, a pair of the pawls 116*a* of the resin catcher 116 may be inserted into the hole 102*a* of the left-and-right adjustment segment 102.

Figure 8C:
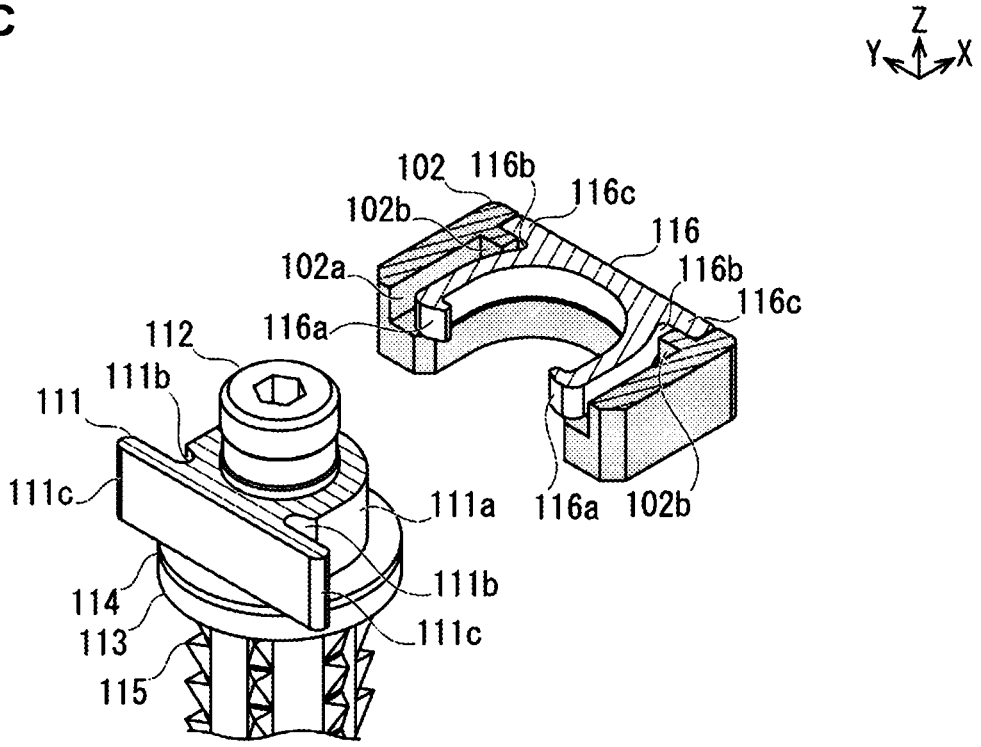
FIG. 8C shows, subsequently to the state of FIG. 8B, a state where the resin catcher is attached to the left-and-right adjustment segment.

As shown in FIG. 8C, subsequently to the state of FIG. 8B, the resin catcher 116 is further inserted into the left-and-right adjustment segment 102. As the result, the recesses 116*b* formed at the base-part side of the pawls 116*a* of the resin catcher 116 engages with the convex part 102*b* of the left-and-right adjustment segment 102. The tops of a pair of the pawls 116*a* of the resin catcher 116 pass through entirely the convex part 102*b* of the left-and-right adjustment segment 102, and then widen to recover the original shape. As described above, by only inserting the connection part (resin catcher 116) into the hole 102*a* of the holder part (front-side body 101 receiving the left-and-right adjustment segment 102), the attachment can become significantly easy.

Figure 8D:
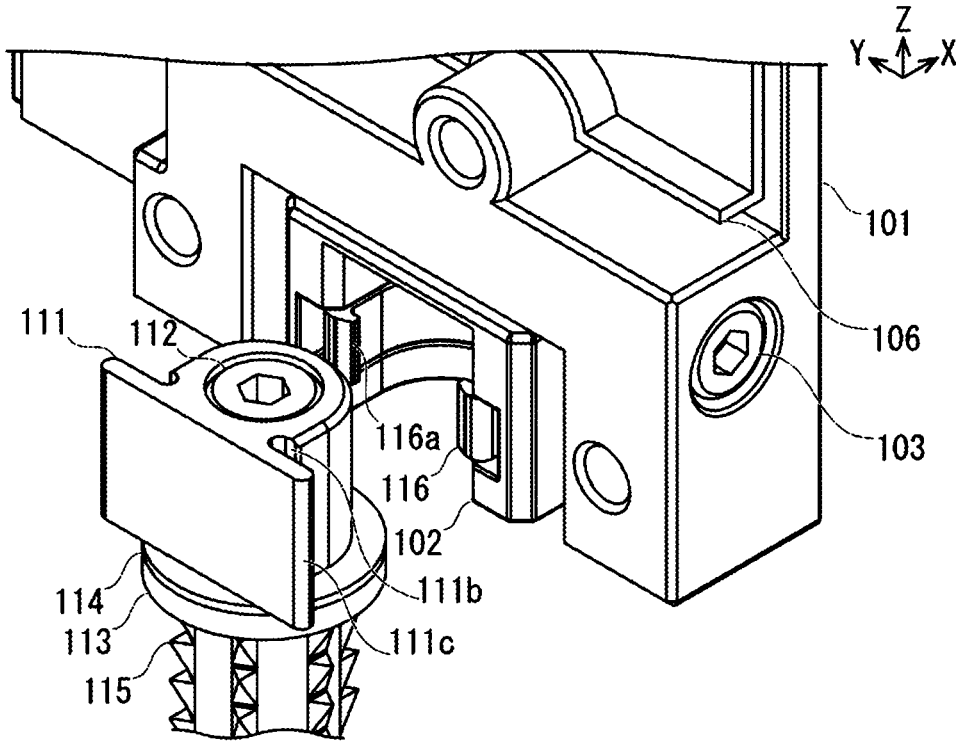
FIG. 8D shows, subsequently to the state of FIG. 8C, under the condition that the resin bush, the left-and-right adjustment segment and the resin catcher are not illustrated as cross sections, the state where the left-and-right adjustment segment attached with the resin catcher is attached to the front-side body.

As shown in FIG. 8D, subsequently to the state of FIG. 8C, the left-and-right adjustment segment 102, to which the resin catcher 116 is attached, is attached to the front-side body 101. That is, the left-and-right adjustment segment 102, to which the resin catcher 116 is attached, is inserted into the receptacle part 101*e* of the front-side body 101. Furthermore, the left-and-right adjustment screw 103 is inserted into the insertion hole 101*f* of the front-side body 101 and then is screwed to the left-and-right adjustment segment 102.

Figure 8E:
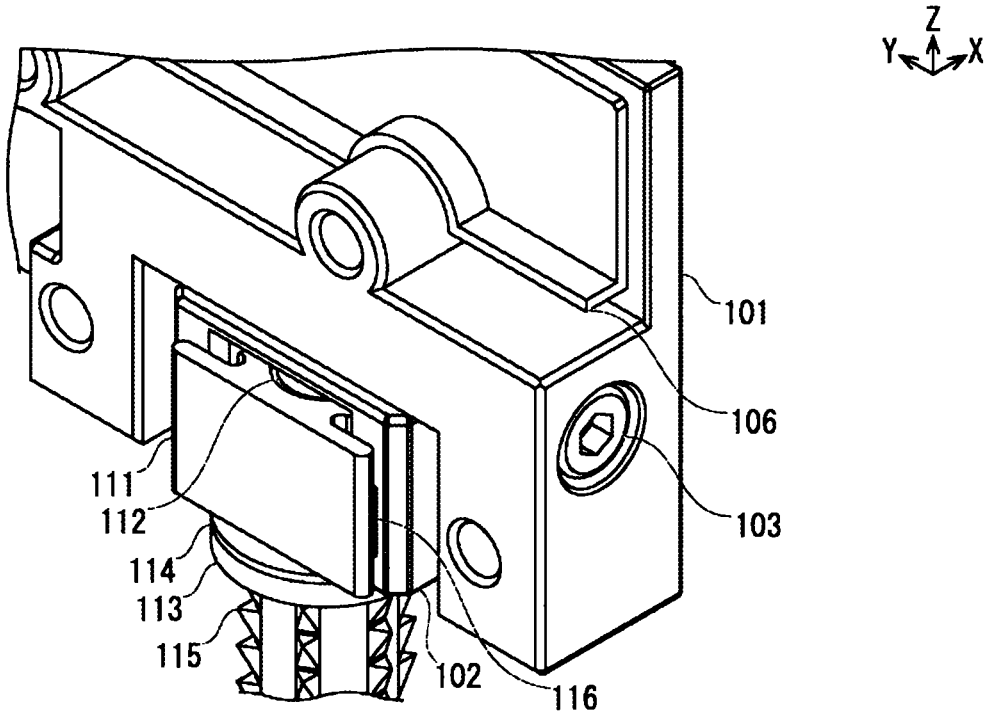
FIG. 8E shows, subsequently to the state of FIG. 8D, the state where the resin catcher attached to the front-side body is attached to the resin bush.

As shown in FIG. 8E, subsequently to the state of FIG. 8D, the resin catcher 116 attached to the front-side body 101 is attached to the resin bush 111. That is, the tops of a pair of the pawls 116*a* of the resin catcher 116 are temporarily widened while contacting with the outer circumference face 111*a* of the resin bush 111, and thereafter, are narrowed and further then are stopped with hooking between a pair of the ends 111*b* of the resin bush 111. As described above, the holder part (front-side body 101 receiving the left-and-right adjustment segment 102) and the supporting part (resin bush 111 inserted into the rotation shaft 112) are engaged temporally by the connection part (resin catcher 116) in the rotatable state.

Figure 8F:
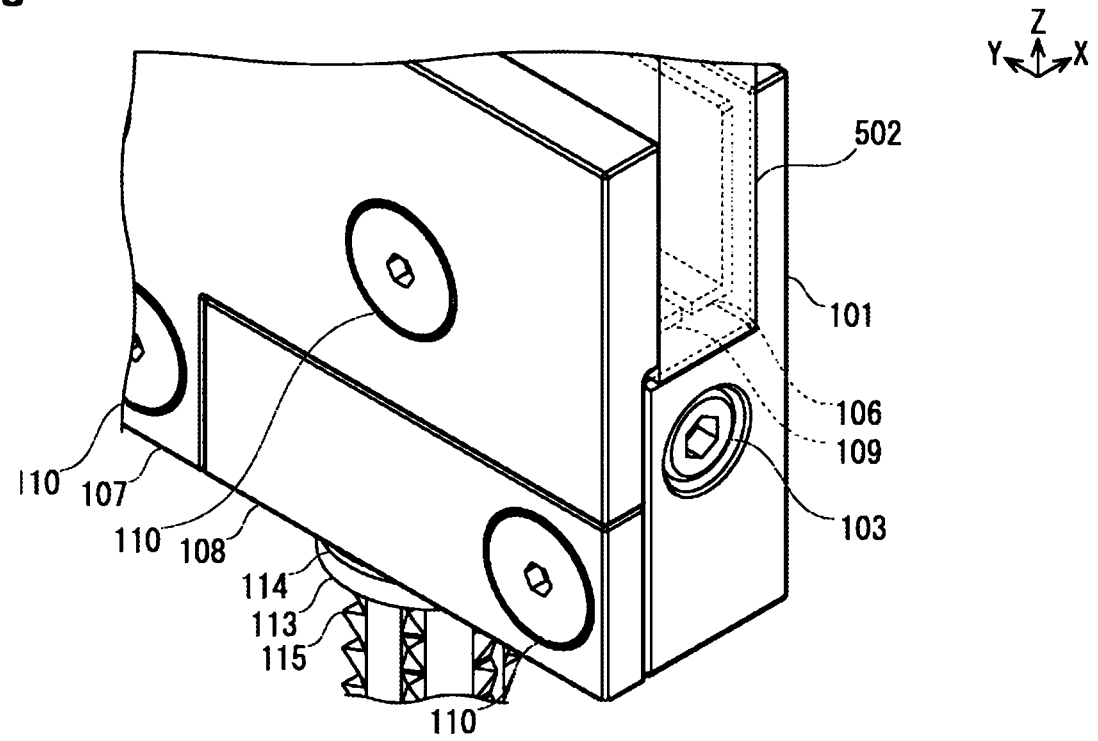
FIG. 8F shows, subsequently to the state of FIG. 8E, the state where a back cover and a back-side body are attached to the front-side body.

As shown in FIG. 8F, subsequently to the state of FIG. 8E, the back cover 108 and the back-side body 107 are attached to the front-side body 101. That is, the back cover 108 and the back-side body 107 are screwed to the front-side body 101 by using the hexagon socket countersunk head screw 110. In this time, by the front-side body 101 attached with the front-side packing 106 together with the back-side body 107 attached to the back-side packing 109, the door 502 is sandwiched to be held.

Main Part of Method for Assembly of Hinge 100 When Resin Bush 111 is Inclined With reference to FIG. 9A and FIG. 9B, a main part of the method for assembling the hinge 100 under the condition that the resin bush 111 is inclined (shifted by rotation) to the resin catcher 116 will be explained.

Figure 9A:
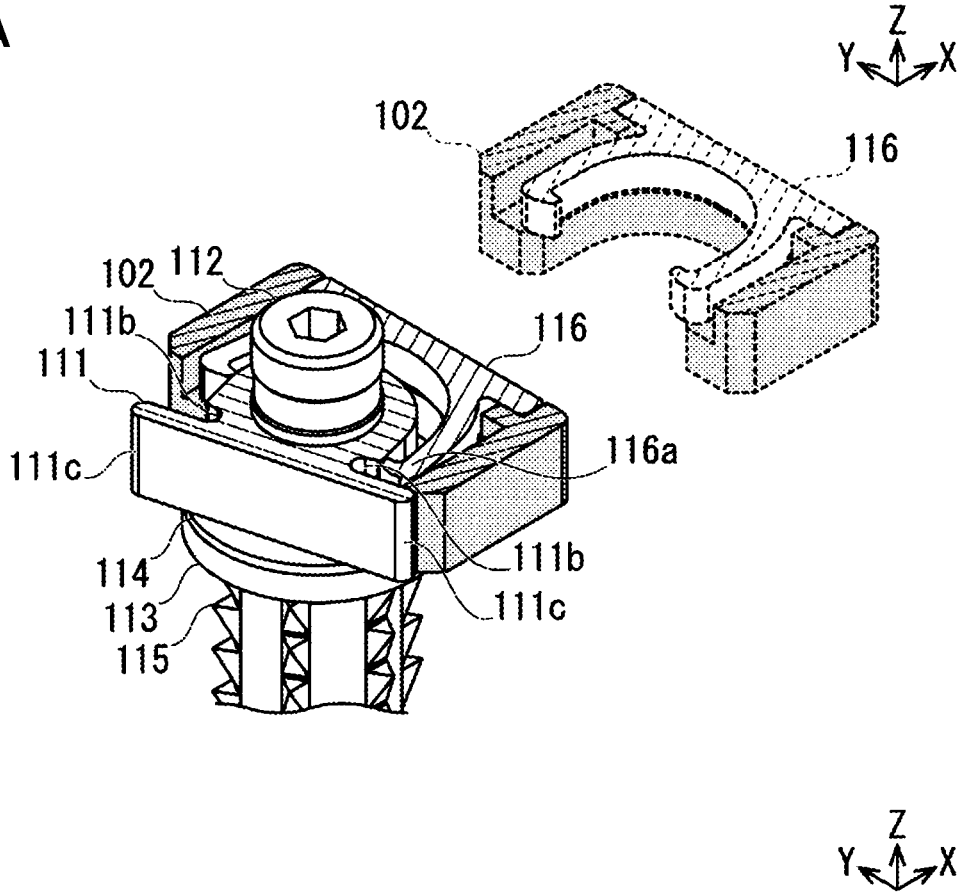
FIG. 9A shows, a perspective view of a main part of a method for assembling the hinge when the resin bush is inclined (shifted by rotation) to the resin catcher in a state that the resin bush, the left-and-right adjustment segment, and the resin catcher are shown as cross sections along the horizontal plane (lateral width direction Y and thickness direction X) and that illustration of the front-side body is omitted, a state on away for attaching the resin catcher attached to the left-and-right adjustment segment is attached to the resin bush.
Figure 9B:
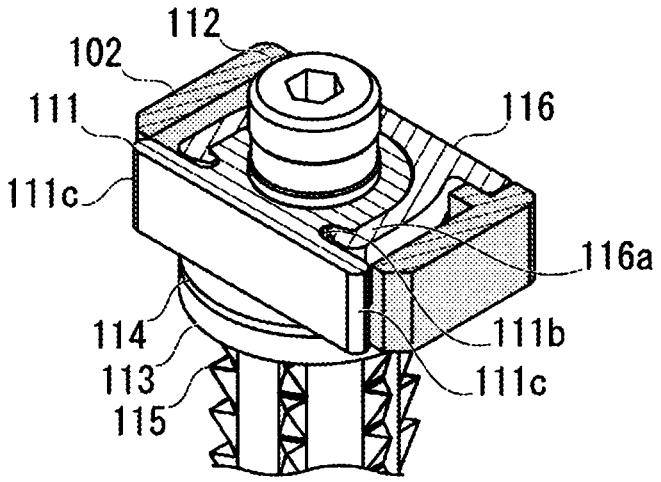
FIG. 9B shows, subsequently to the state of FIG. 9A, the state where the resin catcher attached to the left-and-right adjustment segment is attached, while correcting inclination of the resin bush (shift by rotation), to the resin bush.

FIG. 9A and FIG. 9B show perspective views of the main part of the method for assembling the hinge 100 under the condition that the resin bush 111 is inclined (shifted by rotation) to the resin catcher 116. FIG. 9A and FIG. 9B are, for easy understanding the invention, the resin bush 111, the left-and-right adjustment segment 102, and the resin catcher 116 are shown as cross sections along the horizontal plane (lateral width direction Y and thickness direction X). Similarly, from FIG. 9A and FIG. 9B, for easy understanding the invention, illustration of the front-side body 101 are omitted.

As shown in FIG. 9A, the resin catcher 116 is attached to the left-and-right adjustment segment 102. The tops of a pair of the pawls 116*a* of the resin catcher 116 are placed opposite to the resin bush 111. The resin bush 111 is inserted rotatably into the rotation shaft 112. Here, the resin bush 111 is inclined along the circumference direction of the rotation axis 112 with respect to the resin catcher 116 attached to the left-and-right adjustment segment 102. In this state, the resin catcher 116 is made to approach to the resin bush 111. The tops of a pair of the pawls 116*a* of the resin catcher 116 become contact with the outer circumference 111*a* of the resin bush 111 and spread along the outer circumference face 111*a*. Here, because the resin bush 111 is inclined along the circumference direction, when one of the flanges 111*c* contacts to the left-and-right adjustment segment 102 or the resin catcher 116, the other flange 111*c* becomes the state spaced from the left-and-right adjustment segment 102 and the resin catcher 116.

As shown in FIG. 9B, subsequently to the state of FIG. 9B, while correcting the inclination (shift by rotation) of the resin bush 111, the resin catcher 116 attached to the left-and-right adjustment segment 102 is attached to the resin bush 111. That is, the resin bush 111, in the condition that one of the flanges 111*c* contacts, for example, to the left-and-right adjustment segment 102, upon pushed with the left-and-right adjustment segment 102, is rotated to make the other flange 111*c* contact with the left-and-right adjustment segment 102. The tops of a pair of the pawls 116*a* of the resin catcher 116 are narrowed along the outer circumference face 111*a* of the resin bush 111 and are stopped by hooking between a pair of the ends 111*b* of the resin bush 111.

Advantageous Effect of Hinge 100

Hereafter, the advantageous effect of the hinge in the first embodiment described so far will be explained.

The hinge 100 comprises the holder part (front-side body 101 receiving the left-and-right adjustment segment 102 and back-side body 107) for holding a door 502, the supporting part for supporting rotatably the holder part (resin bush 111 inserted in a rotation shaft 112), and the connection part (resin catcher 116) for connecting the holder part to the supporting part and the resin catcher 116 comprises an attachment part (recesses 116*b*) for attaching to the holder part and the pawls 116*a* for gripping elastically the supporting part.

According to such hinge 100, the resin catcher 116 has the recesses 116*b* for attaching to the holder part. Furthermore, the pawls 116*a* of the resin catcher 116 can be easily connected to the supporting part (resin bush 111 inserted into the rotation axis 112) by causing resilient deformation. Therefore, according to such hinge 100, to the holder part for holding a door 502 (front-side body 101 receiving the left-and-right adjustment segment 102 and back-side body 107), the supporting part (resin bush 111 inserted in a rotation shaft 112) can be attached easily.

The hinge 100 is preferably formed with the convex part 102*b* protruding toward inside within the holding part having the hole 102*a* for receiving the resin catcher 116, and the attachment part preferably consists of the recesses 116*b* for engaging with and attached to the convex part 102*b*.

According to such hinge 100, the resin catcher 116 to which the recesses 116*b* are formed can be attached well, for example, to the left-and-right adjustment segment 102 to which the convex part 102*b* is formed.

In the hinge 100, the holder part (front-side body 101 receiving the left-and-right adjustment segment 102) preferably includes the holder member (front-side body 101) for holding the door and a receptacle member (left-and-right adjustment segment 102) attached to the front-side body 101, and the left-and-right adjustment segment 102 preferably includes the hole 102*a* for receiving the resin catcher 116.

According to such hinge 100, the holder part can be embodied by the extremely simple configuration.

In the hinge 100, the resin catcher 116 is preferably held by sandwiching between the front-side body 101 and the left-and-right adjustment segment 102.

According to the hinge 100, the resin catcher 116 can be held securely by the front-side body 101 and the left-and-right adjustment segment 102.

In the hinge 100, the supporting part preferably includes a shaft member (rotation axis 112) attached to the side of the member (casing 501) for attaching the door 502 and the connected member (resin bush 111) to which the rotation axis 112 is attached rotatably and the resin catcher 116 is connected.

According to the hinge 100, the resin catcher 116 can be attached indirectly to the rotation axis 112 through the resin bush 111. That is, for example, without restricted from specifications of an outer shape and a property (for example, friction coefficient) of the rotation axis 112 attached to the side of the casing 501, the resin catcher 116 can be configured.

In the hinge 100, the resin bush 111 is preferably engaged with the concave ends 111*b* formed by the cylinder shape and by cutting a part of the cylinder shape along the axis direction.

According to such hinge 100, when comparing to the case that a resin bush is formed by the cylinder shape without the notch, a connection part (hooking part) of the pawls 116*a* of the resin catcher 116 with the resin bush 111 can be miniaturized so that the deformation amount thereof can be reduced. Now, the pawls of the resin catcher, when the resin bush is formed as a simple cylinder shape, since the sufficient engagement can not be attained without the significant contact with the resin bush, the parts for the engagement become large sized ones so that the deformation amount thereof becomes large.

In the hinge 100, the resin bush 111 is preferably formed with the flanges 111*c* having the rectangular shape extending toward outwardly from the ends 111*b*, and the flanges 111*c* preferably contact, when the pawls 116*a* are connected to the ends 111*b*, to the holder part (front-side body 101 receiving the left-and-right adjustment segment 102).

According to such hinge 100, the resin catcher 116 can be attached to the resin bush 111 while correcting the inclination (shift by rotation) of the resin bush 111. That is, the resin bush 111, under the condition that the flange 111*c* contacts with the left-and-right adjustment segment 102 to which the resin bush 111 is attached, upon being pushed, rotates to correct the inclination. Therefore, because the resin catcher 116 can be attached to the resin bush 111 without considering the inclination of the resin bush 111, the hinge 100 can improve significantly the workability for the assembly.

Second Embodiment

The hinge of a second embodiment is different from the above described hinge 100 of the first embodiment in the point that the resin catcher 216 is approached to the holder part (front-side body 101 receiving the left-and-right adjustment segment 102) from the back side and is inserted into the hole 102*a* formed to the left-and-right adjustment segment 102. In the above described hinge 100 in the first embodiment, the resin catcher 116 is approached to the holder part (front-side body 101 receiving the left-and-right adjustment segment 102) from the front side and is inserted into the hole 102*a* formed to the left-and-right adjustment segment 102.

With respect to the hinge of the second embodiment, explanation will be given only to configurations different from the above described first embodiment.

Configuration of Hinge

Figure 10A:
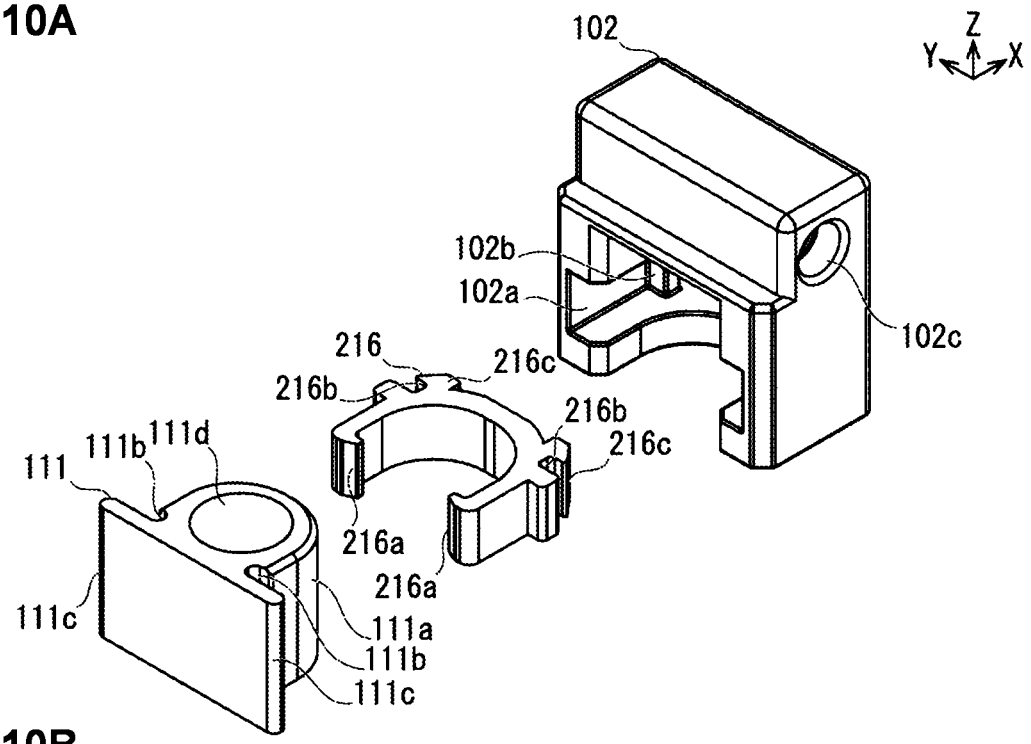
FIG. 10A shows a perspective view of the resin bush and the left-and-right adjustment segment of the hinge according to a second embodiment from the back side.
Figure 10B:
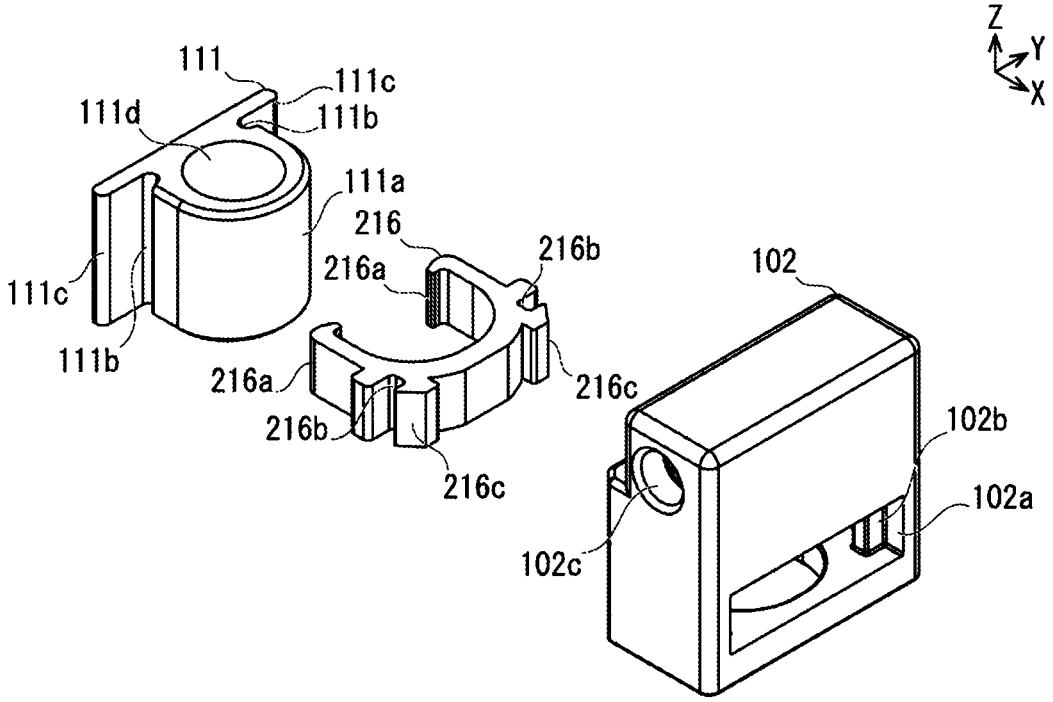
FIG. 10B shows a perspective view of the resin bush and the left-and-right adjustment segment of the hinge according to a second embodiment from the front side.

With reference to FIG. 10A and FIG. 10B, specific configurations of a resin catcher 216 of the hinge according to the second embodiment will be explained.

FIG. 10A shows a perspective view illustrating the resin bush 111, the left-and-right adjustment segment 102, and a resin catcher 216 from the back side. FIG. 10B is a perspective view illustrating the resin bush 111, the left-and-right adjustment segment 102 and the resin catcher 216 according to the second embodiment from the front side.

The resin catcher 216 is, as shown in FIG. 10A and FIG. 10B, formed with pawls 216*a* being elastically deformable and to be connected to the resin bush 111. The resin catcher 216 is formed with snap-fits 216*c* being elastically deformable at a base-end side of the pawls 216*a*. In the resin catcher 216, top-end sides of the snap-fits 216*c* contact to and are being deformed by the convex part 102*b* formed inside the hole 102*a* of the left-and-right adjustment segment 102 and then are inserted into the hole 102*a*. The resin catcher 216 is held by hooking the snap-fits 216*c* with the front-side body 101 and the left-and-right adjustment segment 102. The resin catcher 216 is formed with recesses 216*b* between the base-end side of the pawls 216*a* and the snap-fits 216*c*.

Main Part of Method for Assembling Hinge

Figure 11A:
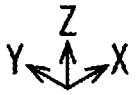
FIG. 11A shows a perspective view of a main part of a method for assembling the hinge according to a second embodiment in a state that the resin bush, the left-and-right adjustment segment, and the resin catcher are shown as cross sections along the horizontal plane (lateral width direction Y and thickness direction X), and shows a state on a way deforming inwardly a pair of snap-fits of the resin catcher and being inserted while being made to pass through the convex part formed in the hole of the left-and-right adjustment segment.
Figure 11A:
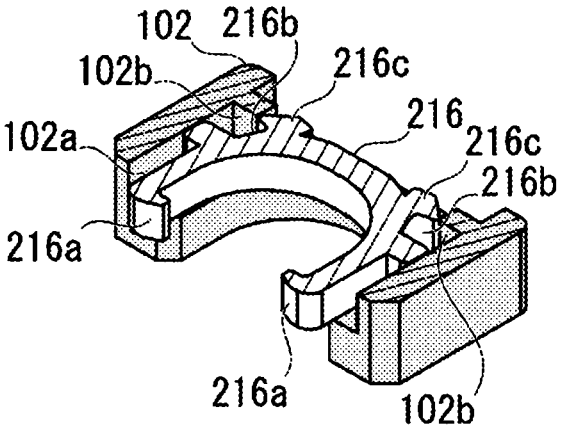
Figure 11A:
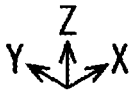
Figure 11B:
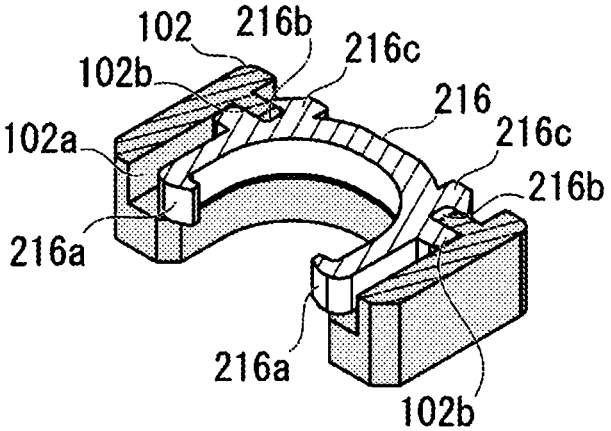
FIG. 11B shows, subsequently to the state of FIG. 11A, the state where the resin catcher is attached to the left-and-right adjustment segment.

With reference to FIG. 11A and FIG. 11B, a main part in an assembling method specific to the hinge of the second embodiment will be explained.

FIG. 11A and FIG. 11B show perspective views illustrating the main part of the assembling method of the hinge. In FIG. 11A and FIG. 11B, for easy understanding of the invention, the left-and-right adjustment segment 102 and the resin catcher 216 are shown as cross sections along the horizontal plane (lateral width direction Y and thickness direction X).

As shown in FIG. 11A, the resin catcher 216 is approached to the left-and-right adjustment segment 102 from the back side. A pair of the snap-fits 216*c* of the resin catcher 216 becomes contact to the convex part 102*b* formed to the hole 102*a* of the left-and-right adjustment segment 102. When the resin catcher 216 is approached to the left-and-right adjustment segment 102, a pair of the snap-fits 216*c* of the resin catcher 216 is deformed as they are bent inwardly with receiving repulsion force from the convex parts 102*b* of the left-and-right adjustment segment 102. As the result, the tops of a pair of the snap-fits 216*c* of the resin catcher 216 narrow the distance therebetween along the lateral direction Y. In this state, a pair of the snap-fits 216*c* of the resin catcher 216 is being inserted into the hole 102*a* of the left-and-right adjustment segment 102.

As shown in FIG. 11B, subsequently to the state of FIG. 11A, the resin catcher 216 is further inserted into the left-and-right adjustment segment 102. As the result, the recesses formed between the base-end side of the pawls 216*a* of the resin catcher 216 and the snap-fits 216*c* become engaged with the convex parts 102*b* of the left-and right adjustment segment 102. A pair of the snap-fits 216*c* of the resin catcher 216 passes entirely through the convex parts 102*b* of the left-and-right adjustment segment 102 and spreads the distance therebetween along the lateral width direction Y to recover the original shape. As such manner, the resin catcher 216 is attached to the left-and-right adjustment segment 102. That is, the connection part (resin catcher 216) can be attached only by inserting into the hole 102*a* of the holder part (front-side body 101 receiving the left-and-right adjustment segment 102).

Advantageous Effect of Hinge

Advantageous effects of the hinge according to the second embodiment described so far will be explained.

The hinge 100 comprises a pair of holder part for holding the door 502 by sandwiching thereof (front-side body 101 receiving the left-and-right adjustment segment 102 and the back-side body 107), a supporting part (resin bush 111 inserted into the rotation axis 112) for supporting rotatably either one of a pair of the holder part (front-side body 101 receiving the left-and-right adjustment segment 102), and the attachment part (recesses 216*b*) for attaching by inserting into the hole 102*a* formed to the holder part at the side supported by the support part (resin bush 111 inserted into the rotation axis 112) and for engaging the inside of the hole 102*a* and the connection part (resin catcher 216) for connecting the holder part at the side supported by the supporting part with the supporting part; the connection part (resin catcher 216) is formed with the elastically deformable pawls 216*a* connected to the supporting part (resin bush 111 inserted into the rotation axis 112) and the elastically deformable snap-fits 216*c* formed at the base-end side of the pawls 216*a*; the recesses 216*b* are formed at the base-end side of the pawls 216*a* and contact to the inside of the hole 102*a* in the condition that the top-end sides of the snap-fits 216*c* are elastically deformed.

According to such hinge, the snap-fits 216*c* of the resin catcher 216 can, without hindering attachment, for example, to the hole 102*a* of the left-and-right adjustment segment 102, sufficiently connect the pawls 216*a* of the resin catcher 216, for example, to the resin bush 111.

The present invention is not limited to the above embodiments and may be modified variously based on features described in claims and such various modification is within scope of the present invention.

Although the explanation has been made such that the connection parts (resin catcher 116 and the resin catcher 216) are received in the receptacle member (left-and-right adjustment segment 102), the connection part may have the configuration attached to the holder part (front-side body 101) formed integrally with the receptacle member (left-and-right adjustment segment 102).

Although the explanation has been made such that the connection parts (resin catcher 116 and the resin catcher 216) are connected to the connected member (resin bush 111), the connection parts may have the configuration to be connected to the axis member (rotation axis 112).

Although the explanation has been provided such that the convex parts 102*b* protruding inwardly are formed in the hole 102*a* of the holder part (front-side body 101 receiving the left-and-right adjustment segment 102) and the attachment part consists of the recesses 116*b* for attaching by engaging with the convex parts 102*b*, the configuration, in which an concave part hollowed outwardly in the hole and the attachment part consists of a protrusion for engaging with the concave part, may be possible.

Although the explanation has been made such that the attachment part is the recesses 116*b* for attaching by engaging with the convex parts 102*b* formed inside the hole 102*a* of the holder part (front-side body 101 receiving the left-and-right adjustment segment 102), the configuration, in which the attachment part is pushed into the inside of the hole 102*a* for receiving the connection part while the same time engaging with and attaching thereto, may be possible.

Although the explanation has been made such that the hole 102*a* formed to the holder part (front-side body 101 receiving the left-and-right segment 102) is a through hole, the hole 102*a* may be configured as a hole having a certain depth.

Although the explanation has been made such that the pawls 116*a* formed to the connection parts (resin catcher 116 and the resin catcher 216) is formed as a pair, the pawl may be configured only by either one (one side).

Although the explanation has been made such that the hinge has the configuration used for a double door with same leaf size corresponding to a pair of doors having the same size, the configuration, which is used for a double door with different leaf size corresponding to a pair of doors having different sizes, or which is used for a single door corresponding to one door, may be allowed.

The present application is based on Japanese Patent Application No. 2017-040558 filed on Mar. 3, 2017 and the disclosure thereof is entirely incorporated herein as reference.

DESCRIPTION OF SIGNS

100 hinge, 102 front-side body (corresponding to holder part), 101*a* base part, 101*b* protrusion part, 101*c* lateral face, 101*d* placement face, 101*e* receptacle part, 101*f* insertion hole, 101*g* screw hole, 102 left-and-right adjustment segment (receptacle member), 102*a* hole, 102*b* convex part, 102*c* through hole, 102*d* screw hole, 103 left-and-right adjustment screw, 104 spring washer, 105 plain washer, 106 front-side packing, 107 back-side body (corresponding to holder part), 107*a* base part, 107*b* lateral face, 107*c* through hole, 108 back cover, 108*a* pawl, 108*b* through hole, 109 back-side packing, 109*a* lateral face, 109*b* placement face, 110 hexagon socket countersunk head screw, 111 resin bush (corresponding to connected member configuring supporting part), 111*a* outer circumference face, 111*b* ends, 111*c* flange, 111*d* hole, 112 rotation axis (corresponding to axis member configuring supporting part), 113 plain washer, 114 resin washer, 115 rasp-cut nut, 116 resin catcher (corresponding to connection part), 116*a* pawl, 116*b* recess (corresponding to attachment part), 116*c* flange, 216 resin catcher (corresponding to connection part), 216*a* pawl, 216*b* recess (corresponding to attachment part), 216*c* snap-fit, 500 storage shelf, 501 casing, 502 door, X thickness (depth) direction of hinge, Y lateral width direction of hinge, Z height direction of hinge.

The invention claimed is:

1. A hinge comprising;

a holder part for holding a door, a supporting part for supporting rotatably the holder part, a connection part for connecting the holder part and the support part, a back cover for covering the supporting part, and a screw for screwing the back cover to the holder part, wherein the connection part comprises an attachment part for attaching to the holder part and a pair of pawls for gripping elastically the supporting part, wherein a direction in which the support part is inserted into the holding part, a direction in which the back cover is attached to the holder part, and a direction in which the screw is screwed are all in a thickness direction which is a X-axis direction of the hinge; and wherein the tops of a pair of the pawls are temporarily widened while contacting with the outer circumference face of the supporting part, thereafter, are narrowed, and grip the supporting part, thereby a pair of the pawls is connected to the supporting part.

2. The hinge of claim 1, wherein a convex part protruding toward inwardly is formed inside the holder part having a hole for receiving the connection part, and the connection part consists of a recess for engaging with and attaching to the convex part.

3. The hinge of claim 1, wherein the holder part comprises a holder member for holding the door and a receptacle member to be connected to the holder member, and the receptacle member is formed with a hole for receiving the connection part.

4. The hinge of claim 3, wherein the connection part is held by sandwiching between the holder member and the receptacle member.

5. The hinge of claim 1, wherein the supporting part comprises;

an axis member attached to a side of a member for attaching the door, and a connected member being attached rotatably to the axis member and connected to the connection part.

6. The hinge of claim 5, wherein the connected member comprises a pair of concave ends formed by cutting a part of a cylinder shape of the connected member along an axial direction, wherein a pair of the concave ends is connected to a pair of the pawls.

7. The hinge of claim 6, wherein the connected member is formed with a flange extending outwardly from the end, and the flange contacts to the holder part when the pawl is connected to the end.

8. The hinge of claim 1, wherein a concave part hollowed outwardly is formed inside a hole for receiving the connection part, and the attachment part consists of a protrusion for engaging with and attaching to the concave part.

9. The hinge of claim 2, wherein the holder part comprises a holder member for holding the door and a receptacle member to be connected to the holder member, and the receptacle member is formed with a hole for receiving the connection part.

10. The hinge of claim 9, wherein the connection part is held by sandwiching between the holder member and the receptacle member.

* * * * *